US006688741B2

(12) United States Patent
Nishikawa

(10) Patent No.: US 6,688,741 B2
(45) Date of Patent: Feb. 10, 2004

(54) INK JET PRINTING MEDIUM FOR AN EMBOSSED INTERIOR DECORATING MEMBER

(75) Inventor: Masaji Nishikawa, Hachioji (JP)

(73) Assignee: University of Southern California, Los Angeles, CA (US)

( * ) Notice: Subject to any disclaimer, the term of this patent is extended or adjusted under 35 U.S.C. 154(b) by 0 days.

(21) Appl. No.: 10/134,794

(22) Filed: Apr. 29, 2002

(65) Prior Publication Data

US 2002/0118267 A1 Aug. 29, 2002

Related U.S. Application Data

(63) Continuation of application No. 09/452,498, filed on Dec. 1, 1999.

(30) Foreign Application Priority Data

| | | |
|---|---|---|
| Dec. 3, 1998 | (JP) | 10-344035 |
| Mar. 1, 1999 | (JP) | 11-052777 |
| Mar. 31, 1999 | (JP) | 11-093797 |

(51) Int. Cl.[7] ..... B41J 2/01

(52) U.S. Cl. ..... 347/105; 347/101; 428/195

(58) Field of Search ..... 347/105, 101, 347/1, 102; 346/135.1; 428/103, 178, 187, 189, 195, 143, 364, 153; 156/247

(56) References Cited

U.S. PATENT DOCUMENTS 5,706,042 A * 1/1998 Takeyama et al. ..... 347/105

FOREIGN PATENT DOCUMENTS

| | | | |
|---|---|---|---|
| JP | 06210740 | * 8/1994 | ..... B29C/65/70 |
| JP | 08-002096 | 1/1996 | |
| JP | 08290505 | * 11/1996 | ..... B32B/5/18 |
| JP | 10-309764 | 11/1998 | |

* cited by examiner

*Primary Examiner*—Stephen D. Meier
*Assistant Examiner*—Manish Shah
(74) *Attorney, Agent, or Firm*—Bingham McCutchen LLP; David W. Maher

(57) ABSTRACT

An ink jet printing medium for an embossed interior decorating member includes a base member having a face, a thermoplastic resin layer deposited on the face of the base member, and a non-aqueous and porous ink receiving layer, deposited on the thermoplastic resin layer, for receiving liquid pigment ink. The thermoplastic resin layer is made of a material including a thermoplastic resin and a heating foaming agent dispersed in the thermoplastic resin. In an aspect, the thermoplastic resin layer has not yet been foamed. In another aspect, the thermoplastic resin layer has already been foamed. In still another aspect, the thermoplastic resin layer has already been foamed and embossed.

13 Claims, 4 Drawing Sheets

INK JET PRINTING MEDIUM FOR AN EMBOSSED INTERIOR DECORATING MEMBER

This is a Continuation of application Ser. No. 09/452,498 filed Dec. 1, 1999.

BACKGROUND OF THE INVENTION

The present invention relates to a medium suitable for producing wallpaper or a curtain for decorating an inner wall of a building, and in particular to an ink jet printing medium suitable for producing an interior decorating member having a pattern printed by ink jet printing and an unevenness pattern formed by embossing.

An interior decorating member for decorating an inner wall of a building, such as wallpaper or a curtain, usually has a picture pattern and an unevenness pattern.

An ordinary method for forming an unevenness pattern is mechanical embossing. In the mechanical embossing, an embossing roll having a heated unevenness pattern is caused to contact, for example, an expanded resin such as vinyl chloride expanded by heating, so as to form an unevenness pattern.

A method for forming a picture pattern may be any one of various printing such as gravure printing, screen process printing, rotary screen process printing and flexography.

Such an interior decorating member is produced by the combination of the step of forming a picture pattern and the step of forming an unevenness pattern. Recently, picture patterns tend to be printed in more various colors year by year.

Picture patterns of interior decorating members are various. Many costs and much time are required for producing a color separation plate or a printing plate for printing these patterns. Furthermore, many trial manufactures and investigations are necessary for decision of a pattern design before the design is put to practical use. Therefore, it has been intensely desired that costs and time necessary for them are saved.

Under such a background, Jpn. Pat. Appln. Publication No. 10-309764 proposes a sheet for producing wallpaper to which a digital printing technique such as ink jet printing is applied so as to produce wallpaper. This document however teaches only coating of stencil paper for the wallpaper with a known ink receiving layer for ink jet printing.

In ink jet printing, ink classified mainly into aqueous dye ink is generally used. Such ink and an ink receiving layer for receiving the ink have low resistance against heat.

Embossing for forming an unevenness pattern generally requires heating at 180–230° C. for a period of time from about 10 seconds to about 2 minutes. For this reason, a medium merely coated with an ink receiving layer for ink jet printing is easily damaged by the heating for embossing. Thus, it is difficult to avoid deterioration in the quality of an interior decorating member that is finally produced.

Experiments on the production of ink jet printing media for embossing by the present inventor demonstrated that the ink receiving layer has a tendency as follows. Upon embossing or foaming accompanied with heating, the ink receiving layer cracks or peels off from a thermoplastic resin layer below it.

BRIEF SUMMARY OF THE INVENTION

An object of the present invention is to provide an ink jet printing medium suitable for producing an embossed interior decorating member having an ink jet printed pattern and an embossed pattern.

Another object of the present invention is to provide an ink jet printing medium for an embossed interior decorating member that has resistance against heating necessary for embossing and that comprises an ink receiving layer that does not easily cracks or peels off by the deformation upon the embossing.

Still another object of the present invention is to provide an ink jet printing medium for an embossed interior decorating member that has been produced without the deterioration in the quality by heating necessary for embossing and that comprises an ink receiving layer that does not easily cracks or peels off by the deformation upon the embossing.

A further object of the present invention is to provide an ink jet printing medium for an embossed interior decorating member that has been produced without the deterioration in the quality by heating necessary for embossing nor cracking or peeling-off of an ink receiving layer by the deformation upon the embossing.

The ink jet printing medium for an embossed interior decorating member of the present invention comprises a base member having a face, a thermoplastic resin layer deposited on the face of the base member, and a non-aqueous and porous ink receiving layer, deposited on the thermoplastic resin layer, for receiving liquid pigment ink. The thermoplastic resin layer is made of a material comprising a thermoplastic resin and a heating foaming agent dispersed in the thermoplastic resin. In an aspect, the thermoplastic resin layer has not yet been foamed. In another aspect, the thermoplastic resin layer has already been foamed. In still another aspect, the thermoplastic resin layer has already been foamed and embossed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawing, which are incorporated in and constitute a part of the specification, illustrate presently preferred embodiments of the invention, and together with the general description given above and the detailed description of the preferred embodiments given below, serve to explain the principle of the invention.

FIG. 2A schematically illustrates a section of an initially-processed product after printing. FIG. 2B schematically illustrates a section of a midway-process product after heating and foaming. FIG. 2C schematically illustrates a section of a finished product after embossing.

FIG. 4A schematically illustrates a section of an initially-processed product after printing. FIG. 4B schematically illustrates a section of a midway-process product after heating and foaming. FIG. 4C schematically illustrates a section of a finished product after embossing.

FIG. 5A schematically illustrates a section of an unfinished product before heating and foaming. FIG. 5B schematically illustrates a section of a finished product after heating and foaming.

FIG. 6A schematically illustrates a section of an unfinished product after printing. FIG. 6B schematically illustrates a section of a finished product after embossing.

FIG. 8A schematically illustrates a section of an initially-processed product before heating and foaming. FIG. 8B schematically illustrates a section of a midway-process product after the heating and foaming. FIG. 8C schematically illustrates a section of a finished product after embossing.

DETAILED DESCRIPTION OF THE INVENTION

First Embodiment

Figure 1:
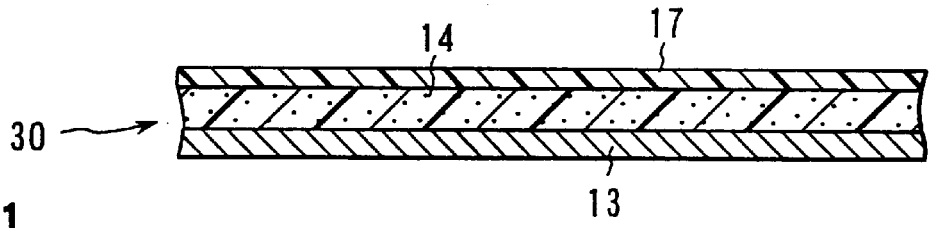
FIG. 1 schematically illustrates a section of an ink jet printing medium for embossed wallpaper according to a first embodiment of the present invention.

Referring to FIG. 1, an ink jet printing medium 30 for embossed wallpaper according to the first embodiment of the present invention will be described.

As illustrated in FIG. 1, the ink jet printing medium 30 for embossed wallpaper comprises a base member or lining paper 13, a thermoplastic resin layer 14 deposited on one surface of the lining paper 13, and a non-aqueous and porous ink receiving layer 17 for receiving a liquid pigment ink. The layer 17 is deposited on a surface of the thermoplastic resin layer 14. The thermoplastic resin layer 14 is made of a material comprising a thermoplastic resin and a heating foaming agent dispersed in the thermoplastic resin, and has not yet been foamed.

The lining paper 13 supports the other layers and provides them a foundation. The lining paper 13 is applied with glue when wallpaper having been produced is put on a wall. Suitable lining paper 13 includes, for example, paper, non-woven cloth, synthetic paper, titanium paper, glass non-woven paper or the like.

The non-foamed thermoplastic resin layer 14 is formed by coating of a material including a thermoplastic resin in which a plasticizer, a stabilizer, a foaming agent, a lubricant, an antioxidant, a filler, a surfactant and the like are homogeneously mixed.

A preferable thermoplastic resin which is most generally used is polyvinyl chloride resin. Other suitable thermoplastic resins include polyacrylic resin, polyvinyl acetate resin, polyurethane resin, polystyrene resin, polyethylene resin, and synthetic rubber.

Suitable plasticizers include, for example, plasticizers of phthalic esters such as dioctyl phthalate, dibutyl phthalate and butylbenzyl phthalate; phosphates; esters of chlorofatty acid; chloroparaffins; epoxys; polyesters and esters of adipic acid.

The stabilizer causes control of decomposition or foaming temperature of the foaming agent. Suitable stabilizers include, for example, composite stabilizers such as cadmium, barium or zinc based stabilizers; lead based stabilizers; tin based stabilizers; calcium based stabilizers.

Suitable foaming agents include, for example, dinitropentamethylenetetramine, azodicarbonamide, toluenesulfonylhydrazine, azobisisobutylnitrile, and benzenesulfonylhydrazine.

The lubricant causes an improvement in workability of embossing. Suitable lubricants include, for example, paraffins, low molecular weight polyolefines, stearic acid, esters of stearic acid, stearyl alcohol, vaseline, and polyglycol esters of fatty acids.

The filler is used to obtain texture or brightness. Suitable fillers include, for example, calcium carbonate, calcium hydroxide, zinc oxide, magnesium oxide, inorganic spheres and organic hollow spheres.

The surfactant causes the thermoplastic resin to be emulsified. Suitable surfactant include, for example, phosphoric monoesters, phosphoric diesters, polyoxyethylene sorbitan monooleate, polyoxyethylene lauryl ether, and polyethyleneglycol monolaurate.

The mixture of these components is applied to the lining paper 13 in the manner that the thickness of the applied film after being dried and gelatinized will be from 0.2 to 0.4 mm, for example, about 0.3 mm. The mixture is heated at 150–250° C., usually 180–230° C., for a period of time from about 10 seconds to about 2 minutes to cause the applied film, that is, the non-foamed thermoplastic resin layer 14 to foam sufficiently. A preferable medium has a thickness of about 0.4 to 1.5 mm after the foaming. In the medium having such a thickness, an unevenness pattern having a suitable depth is precisely formed by embossing.

As will be described later, the porous ink receiving layer 17 and ink for forming a picture pattern are heated at 180–230° C. for a period of time from about 10 seconds to about 2 minutes in a wallpaper-producing step.

Therefore, the ink to be used is preferably pigment ink. This is because heating causes dye ink, which is widely used in ink jet printing, to be decomposed and faded or discolored, or alternatively the resultant picture pattern flows or spreads with water after the formation of wallpaper.

For such reasons, the ink receiving layer 17 needs to be porous in order to absorb the solvent of the pigment ink and hold pigment particles without dropping out.

The ink receiving layer 17 preferably exhibits good ink absorbability and gives an appropriate print dot size. Such a preferable ink receiving layer is a porous film in which particles are bonded to each other with a binder resin in a dry state thereof and with which light is intensely scattered. In this preferable layer, condensed particles and pores observed with a scanning electron microscope, which have a diameter of 1 to 30 $\mu$m, are rubbly. The volume ratio of the pores, that is, the porosity is from 20 to 70%, Namely, the preferable ink receiving layer 17 has a pore size of 1 to 30 $\mu$m and a pore volume ratio, that is, a porosity of 20 to 70%.

This ink receiving layer 17 absorbs the solvent of the pigment ink sufficiently since the layer 17 contains particles that are porous by themselves and condensed bodies of the particles. Therefore, the solvent of the ink that is poured permeates the particles or the pores of the particles immediately, so that the ink is absorbed into them. The particles of the pigment fix onto the surfaces of the particles. As a result, a good image is formed.

The ink receiving layer 17 preferably has a thickness of 5 to 25 μm. The thickness over 25 μm makes it difficult to transfer the unevenness pattern, the thickness less than 5 μm provides insufficient ink absorbing power. The ink receiving layer 17 having a thickness of 5 to 25 μm sufficiently absorbs a relatively small amount of the pigment ink, which is necessary for the formation of a picture pattern of wallpaper, which generally has a relatively low concentration.

The porous ink receiving layer 17 may be made from various materials in various manners. The layer 17 is made, for example, by applying a liquid including a binder resin in which white or colorless particles such as silica or alumina or both are dispersed, and then drying the applied layer. The binder may be acrylic resin, polymethyl methacrylate resin, copolymer resin of methyl methacrylate and amide resin, polyester resin, ethylene-vinyl acetate copolymer, vinyl chloride-vinyl acetate copolymer, polyurethane resin or the like.

Particularly, the ethylene-vinyl acetate copolymer, the vinyl chloride-vinyl acetate copolymer and the polyurethane resin have softness, so as to give softness to the resultant ink receiving layer 17. Therefore, the ink receiving layer 17 preferably comprises a binder resin containing 20–100% by weight of the resin having such softness. The ink receiving layer 17 as described above has a high resistance against great deformation upon embossing so that the layer 17 does not crack or peel off easily. As long as the ink receiving layer 17 includes the binder resin mentioned above, it may have a thickness above 25 μm, i.e., the upper limit of the above-noted range.

Particularly, the ethylene-vinyl acetate copolymer has a rubbery property that restoring force is exhibited against deformation. Thus, this copolymer is especially suitable for prevention of cracking and peeling-off of the ink receiving layer 17.

As described above, the ink jet printing medium for embossed wallpaper according to the present embodiment resists sufficiently against heating necessary for embossing, and the ink receiving layer does not easily crack or peel off upon the embossing.

Figure 2A:
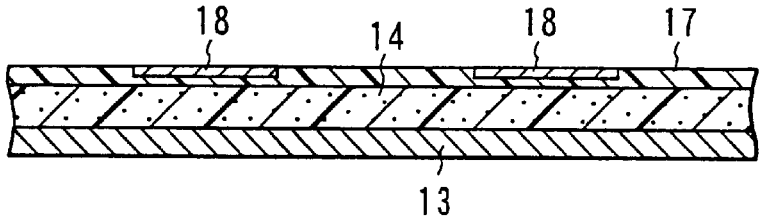
FIGS. 2A–2C illustrate a series of steps for producing embossed wallpaper by use of the ink jet printing medium illustrated in FIG. 1.
Figure 2B:
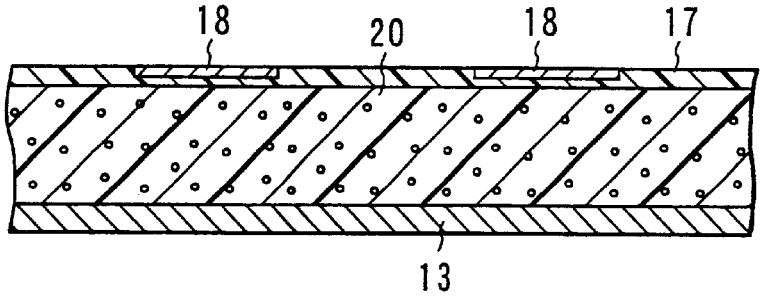
Figure 2C:
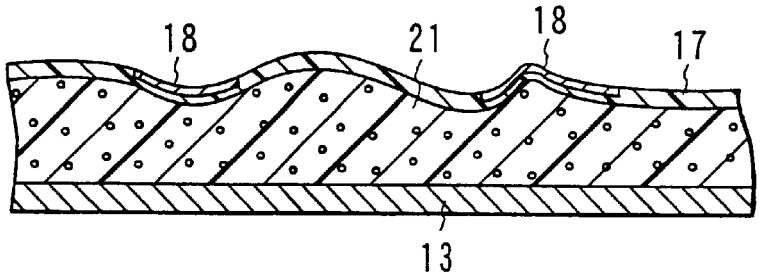

Referring now to FIGS. 2A–2C, a method for producing a piece of wallpaper by use of the above-mentioned ink jet printing medium 30 for embossed wallpaper will be described.

A pigment ink is first jetted, in a pattern form, to the porous ink jet receiving layer 17 of the ink jet printing medium 30 for embossed wallpaper (see FIG. 1) by means of an ink jet printer, so as to form a given picture pattern 18 (see FIG. 2A).

Next, the ink jet printing medium 30 for embossed wallpaper on which the picture pattern 18 is formed is introduced into a heating device such as an oven to heat the medium 30 at 180–230° C. for a period of time from about 10 seconds to about 2 minutes, thereby foaming the non-foamed thermoplastic resin layer 14. The heating causes the non-foamed thermoplastic resin layer 14 to turn to a foamed resin layer 20 having a thickness about 3–5 times that of the layer 14 (see FIG. 2B).

Subsequently, a heated embossing roller or a heated embossing plate is applied to the medium 30 from the side of the ink receiving layer 17, to form an unevenness pattern, that is, to perform embossing. In this embossing, the foamed resin layer 20 easily gets to fit to the unevenness of the embossing roller or the embossing plate since the foamed resin layer 20 has thermoplasticity and many pores. The embossing causes the formed resin layer 20 to turn to an embossed resin layer 21. Therefore, a piece of embossed wallpaper on which the unevenness pattern is faithfully transferred is obtained (see FIG. 2C).

In this embodiment, the foaming and the embossing are performed in separate steps, but the embossing step may also serve as the heating step for foaming the resin.

Second Embodiment

Figure 3:
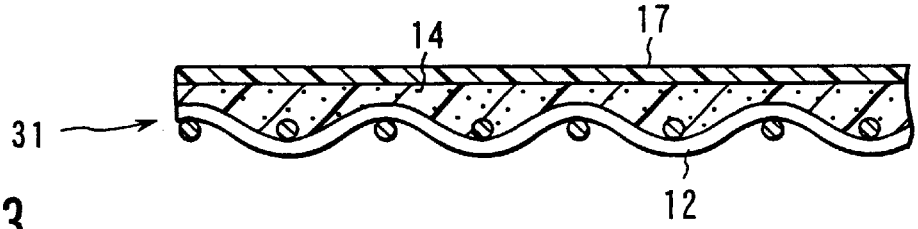
FIG. 3 schematically illustrates a section of an ink jet printing medium for an embossed curtain according to a second embodiment of the present invention.

Referring to FIG. 3, an ink jet printing medium 30 for an embossed curtain according to the second embodiment of the present invention will be described.

As illustrated in FIG. 3, the ink jet printing medium 31 for an embossed curtain comprises a base member or woven cloth 12 of loose texture, a thermoplastic resin layer 14 deposited on one surface of the woven cloth 12, and a non-aqueous and porous ink receiving layer 17 for receiving a liquid pigment ink. The layer 17 is deposited on a surface of the thermoplastic resin layer 14. The thermoplastic resin layer 14 is made of a material comprising a thermoplastic resin and a heating foaming agent dispersed in the thermoplastic resin, and has not yet been foamed.

The woven cloth 12 is made by weaving threads made of, for example, cotton or polyester, and prevents elongation of the non-foamed thermoplastic resin layer 14 to maintain the shape thereof stably.

The non-foamed thermoplastic resin layer 14 and the ink receiving layer 17 are the same as those described in detail in the first embodiment, to omit explanation on these members.

As described above, the ink jet printing medium for an embossed curtain according to the present embodiment resists sufficiently against heating necessary for embossing and the ink receiving layer does not easily crack or peel off upon the embossing because of the same reasons as about the ink jet printing medium for embossed wallpaper of the first embodiment.

Figure 4A:
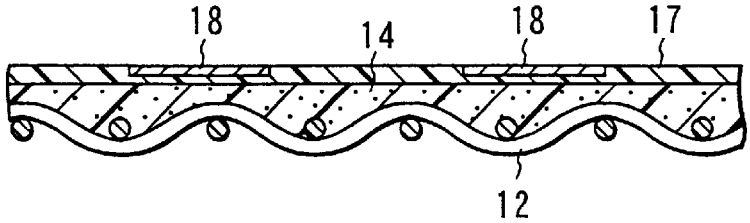
FIGS. 4A–4C illustrate a series of steps for producing an embossed curtain by use of the ink jet printing medium for an embossed curtain illustrated in FIG. 3.
Figure 4B:
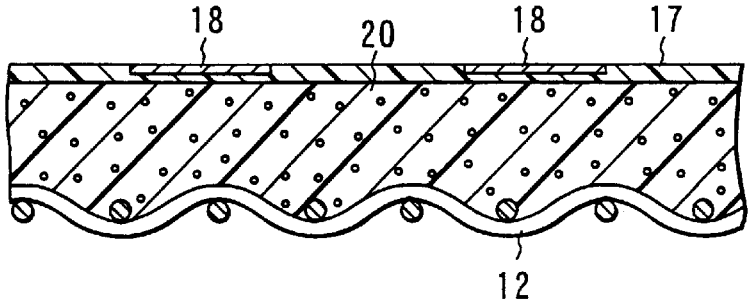
Figure 4C:
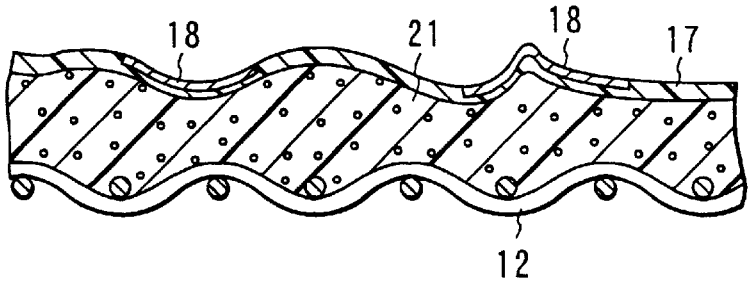

Referring now to FIGS. 4A–4C, a method for producing an embossed curtain by use of the above-mentioned ink jet printing medium 31, which is illustrated in FIG. 3, will be described.

A pigment ink is first jetted, in a pattern form, to the porous ink jet receiving layer 17 of the ink jet printing medium 31 for an embossed curtain (see FIG. 3) by means of an ink jet printer, so as to form a given picture pattern 18 (see FIG. 4A).

Next, the non-foamed thermoplastic resin layer 14 is heated and foamed through the same foaming step as illustrated in FIG. 2B (see FIG. 4B), and the same embossing as illustrated in FIG. 2C is applied thereto, so as to obtain an embossed curtain (see FIG. 4C).

In this embodiment, the foaming and the embossing are performed in separate steps, but the embossing step may also serve as the heating step for foaming the resin.

Third Embodiment

Figure 5A:
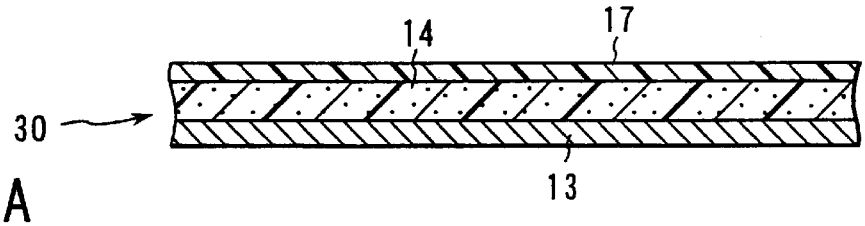
FIGS. 5A and 5B illustrate steps for producing an ink jet printing medium for embossed wallpaper according to a third embodiment of the present invention.
Figure 5B:
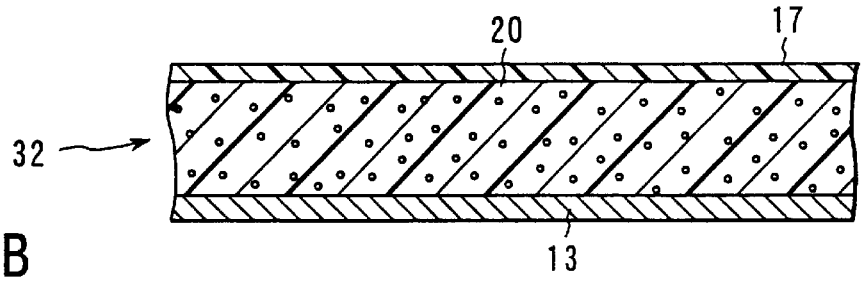

Referring to FIGS. 5A and 5B, an ink jet printing medium 32 for embossed wallpaper according to the third embodiment of the present invention will be described.

As illustrated in FIG. 5B, the ink jet printing medium 32 for embossed wallpaper comprises a base member or lining paper 13, a thermoplastic resin layer 20 which is deposited on one surface of the lining paper 13 and has already been foamed, and a non-aqueous and porous ink receiving layer 17 for receiving a liquid pigment ink. The layer 17 is deposited on a surface of the thermoplastic resin layer 20.

The ink jet printing medium 32 for embossed wallpaper is produced by heating and foaming a lamination structure body 30 that comprises the lining paper 13, a non-foamed thermoplastic resin layer 14 deposited on the lining paper 13 and made of a material comprising a thermoplastic resin and a heating foaming agent dispersed in the thermoplastic resin and the ink receiving layer 17 deposited on a surface of the thermoplastic resin layer 14.

In other words, the ink jet printing medium 32 for embossed wallpaper of the present embodiment is produced by heating and foaming the ink jet printing medium 30 for embossed wallpaper of the first embodiment. Accordingly, various conditions of the heating step for foaming the thermoplastic resin 14 are the same as in the first embodiments.

Alternatively, the ink jet printing medium 32 for embossed wallpaper may be produced by heating and foaming a lamination structure body that comprises the lining paper 13, and the non-foamed thermoplastic resin layer 14 made of a material comprising a thermoplastic resin and a heating foaming agent dispersed in the thermoplastic resin, and then depositing the ink receiving layer 17 on a surface of the foamed thermoplastic resin layer.

The lining paper 13, the non-foamed thermoplastic resin layer 14 and the ink receiving layer 17 are the same as those described in detail in the first embodiment, to omit explanation on these members.

As described above, the ink jet printing medium for embossed wallpaper according to the present embodiment can be produced without the deterioration in the quality by heating necessary for the embossing, and the ink receiving layer does not easily crack or peel off upon the embossing because of the same reasons as about the ink jet printing medium for embossed wallpaper according to the first embodiment.

Figure 6A:
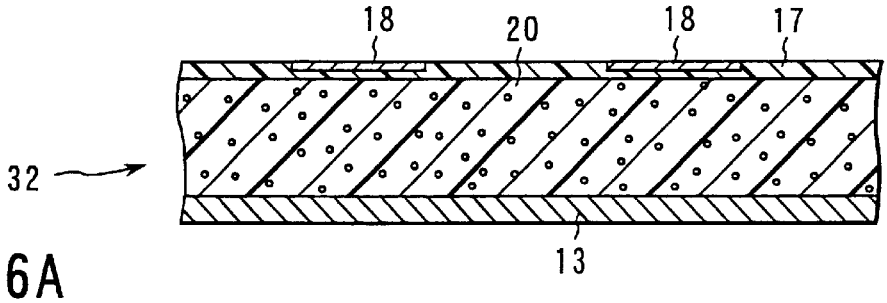
FIGS. 6A and 6B illustrate steps for producing embossed wallpaper by use of the ink jet printing medium for embossed wallpaper illustrated in FIG. 5B.
Figure 6B:
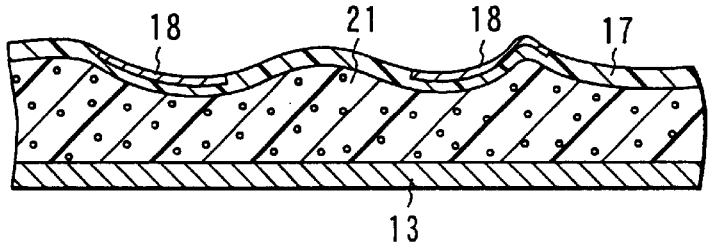

Referring now to FIGS. 6A–6B, a method for producing a piece of wallpaper by use of the above-mentioned ink jet printing medium 32 for embossed wallpaper will be described.

A pigment ink is first jetted, in a pattern form, to the porous ink jet receiving layer 17 of the ink jet printing medium 32 for embossed wallpaper (see FIG. 5B) by means of an ink jet printer, so as to form a given picture pattern 18 (see FIG. 6A).

Subsequently, a heated embossing roller or a heated embossing plate is applied to the medium 30 from the side of the ink receiving layer 17 to perform embossing. In this embossing, the foamed resin layer 20 easily gets to fit to the unevenness of the embossing roller or the embossing plate since the foamed resin layer 20 has thermoplasticity and many pores. The formed resin layer 20 turns to an embossed resin layer 21 by embossing. Therefore, a piece of embossed wallpaper on which the unevenness pattern is faithfully transferred is obtained (see FIG. 6B).

As described above, in the step for producing the wallpaper by use of the ink jet printing medium for embossed wallpaper of the present embodiment, the step necessary after the formation of the picture pattern 18 is only the step of embossing. A standardized step of foaming, which requires large-scale facilities, can be carried out in a large way in a factory having exclusive conveniences. This is effective.

Fourth Embodiment

Figure 7:
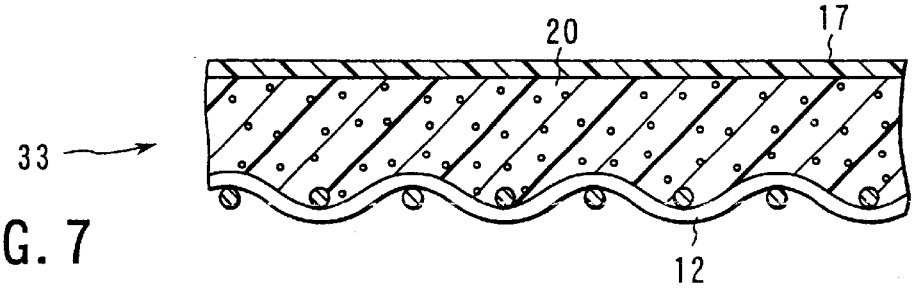
FIG. 7 schematically illustrates a section of an ink jet printing medium for an embossed curtain according to a fourth embodiment of the present invention.

Referring to FIG. 7, an ink jet printing medium 33 for an embossed curtain according to the fourth embodiment of the present invention will be described.

As illustrated in FIG. 7, the ink jet printing medium 33 for an embossed curtain comprises a base member or woven cloth 12 of loose texture, a foamed thermoplastic resin layer 20 deposited on one surface of the woven cloth 12, and a non-aqueous and porous ink receiving layer 17 for receiving a liquid pigment ink. The layer 17 is deposited on a surface of the foamed thermoplastic resin layer 20.

The ink jet printing medium 33 for an embossed curtain of the present embodiment is equivalent to a structure wherein the lining paper 13 of the ink jet printing medium 32 for embossed wallpaper illustrated in FIG. 5B is replaced by the woven cloth 12 of loose texture. Accordingly, the printing medium 33 of the present embodiment and the process for producing the medium 33 are the same as in the third embodiment except the base member. The process of using this to produce an embossed curtain is the same as in the third embodiment except use of finished products. Thus, explanation of them is omitted.

Fifth Embodiment

Figure 8A:
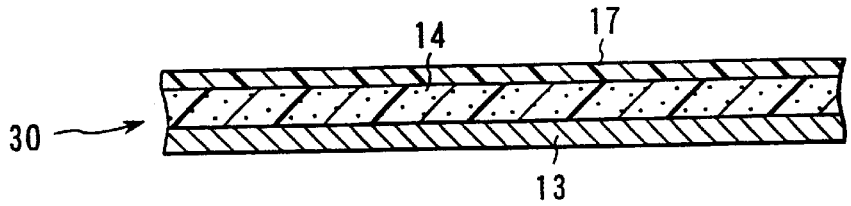
FIGS. 8A–8C illustrate steps for producing an ink jet printing medium for embossed wallpaper according to a fifth embodiment of the present invention.
Figure 8B:
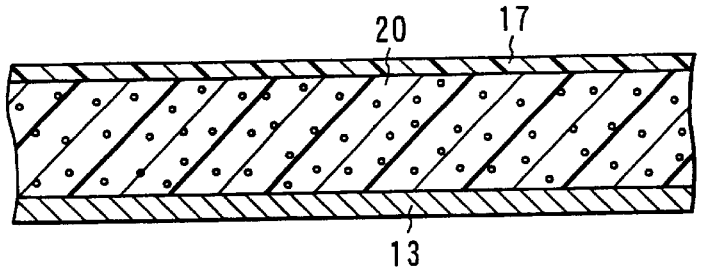
Figure 8C:
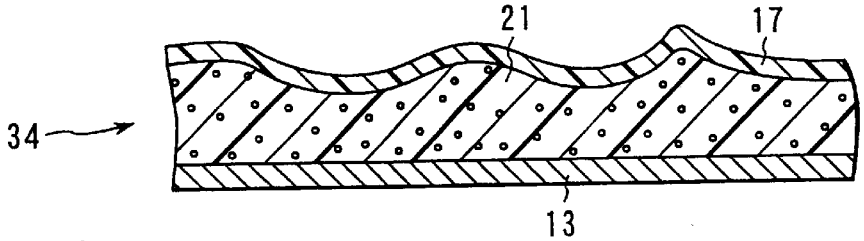

Referring to FIGS. 8A–8C, an ink jet printing medium 34 for embossed wallpaper according to the fifth embodiment of the present invention will be described.

As illustrated in FIG. 8C, the ink jet printing medium 34 for embossed wallpaper comprises a base member or lining paper 13, a thermoplastic resin layer 21 which is deposited on one surface of the lining paper 13 and has already been foamed and embossed, and a non-aqueous and porous ink receiving layer 17 for receiving a liquid pigment ink. The layer 17 is deposited on a surface of the thermoplastic resin layer 21.

The ink jet printing medium 34 for embossed wallpaper is produced through the steps shown in, for example, FIGS. 8A and 8B.

As shown in FIG. 8A, prepared is a lamination structure body 30 that comprises the lining paper 13, a non-foamed thermoplastic resin layer 14 deposited on the lining paper 13 and made of a material comprising a thermoplastic resin and a heating foaming agent dispersed in the thermoplastic resin, and the ink receiving layer 17 deposited on a surface of the thermoplastic layer 14. In other words, the ink jet printing medium 30 for embossed wallpaper according to the first embodiment is prepared.

As shown in FIG. 8B, next, the thermoplastic resin layer 14 is foamed by heating. This allows the thermoplastic resin layer 14 to turn to a foamed thermoplastic resin layer 20. Various conditions of the heating step for foaming the thermoplastic resin layer 14 are the same as in the first embodiment.

Subsequently, a heated embossing roller or a heated embossing plate is applied to the medium 34 from the side of the ink receiving layer 17, to perform embossing. Various conditions of the embossing are the same as in the first embodiment. As described in detail about the first embodiment, the unevenness of the embossing roller or the embossing plate is easily transferred since the foamed thermoplastic resin layer 20 has thermoplasticity and many pores. Therefore, the foamed thermoplastic resin layer 20 turns to an embossed resin layer 21 having an unevenness pattern. The ink receiving layer 17 deforms accordingly. As a result, the ink jet printing medium 34 for embossed wallpaper of the present embodiment (illustrated in FIG. 8C) is obtained.

As described above, the ink jet printing medium for embossed wallpaper according to the present embodiment can be produced without the deterioration in the quality by heating necessary for the embossing nor without cracking or peeling-off of the ink receiving layer by deformation upon the embossing.

Figure 9:
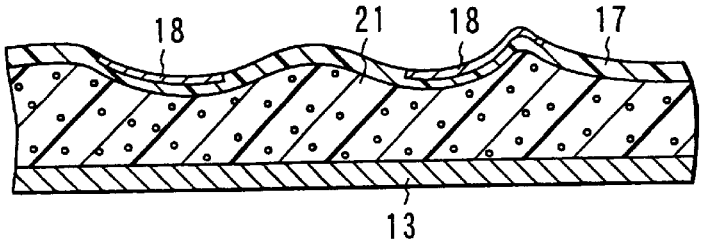
FIG. 9 schematically illustrates a section of wallpaper finished by printing a picture pattern on the ink jet printing medium for embossed wallpaper illustrated in FIG. 8C.

As illustrated in FIG. 9, the thus produced ink jet printing medium 34 for embossed wallpaper turns to a piece of embossed wallpaper only by printing a given picture pattern 18 thereon with ink jet printing ink.

In this way, the ink jet printing medium for embossed wallpaper of the present embodiment has already been embossed. Therefore, a piece of embossed wallpaper can be produced without additional post-treatment or processing after printing with ink jet printing ink.

That is, the foaming and embossing, which require high-priced and large-scale facilities, can be carried out in a large way in a factory having exclusive conveniences. Accordingly, arbitrary pieces of wallpaper having a desired picture pattern can easily be produced.

The ink applied to the ink jet printing medium for embossed wallpaper of the present invention is preferably pigment ink excellent in water-resistance and light-resistance. However, aqueous dye ink, which is poor in heat-resistance, may be used because the printing medium does not require any heating step after printing.

Sixth Embodiment

Figure 10:
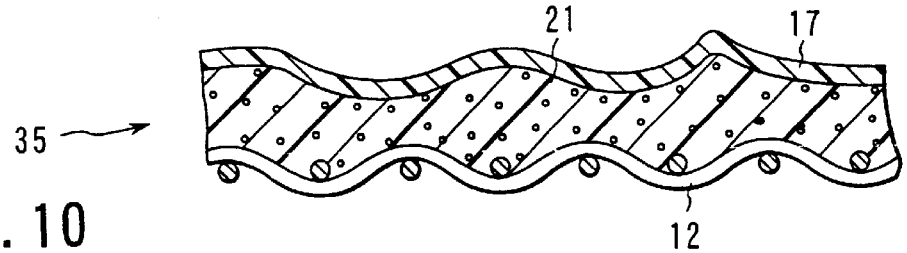
FIG. 10 schematically illustrates a section of an ink jet printing medium for an embossed curtain according to a sixth embodiment of the present invention.

Referring to FIG. 10, an ink jet printing medium 35 for an embossed curtain according to the sixth embodiment of the present invention will be described.

As illustrated in FIG. 10, the ink jet printing medium 35 for an embossed curtain comprises a base member or woven cloth 12 of loose texture, an embossed resin layer 21 which is deposited on one surface of the woven cloth 12 and has been foamed and embossed, and a non-aqueous and porous ink receiving layer 17 for receiving a liquid pigment ink. The layer 17 is deposited on a surface of the embossed resin layer 21.

The ink jet printing medium 35 for an embossed curtain of the present embodiment is equivalent to a structure wherein the lining paper 13 of the ink jet printing medium 34 for embossed wallpaper illustrated in FIG. 8C is replaced by the woven cloth 12 of loose texture. Accordingly, the printing medium 35 of the present embodiment and the process for producing the medium 35 are the same as in the fifth embodiment except the base member. The process of using this to produce an embossed curtain is the same as in the fifth embodiment except use of finished products. Thus, explanation of them is omitted.

Additional advantages and modifications will readily occur to those skilled in the art. Therefore, the invention in its broader aspects is not limited to the specific details and representative embodiments shown and described herein. Accordingly, various modifications may made without departing from the spirit or scope of the general inventive concept as defined by the appended claims and their equivalents.

What is claimed is:

1. A method for forming embossed wallpaper from a medium including a base member, a thermoplastic resin layer deposited on the base member, the thermoplastic resin layer being made from a material including a thermoplastic resin, and a non-aqueous and porous ink receiving layer deposited on the thermoplastic resin layer, the method comprising:

heating and embossing the ink receiving layer to form an uneven pattern on the ink receiving layer; and ink-jet printing an image on the ink receiving layer after the heating and embossing.

2. A method for forming embossed wallpaper according to claim 1, wherein the embossing is performed concurrently with the heating.

3. A method for forming embossed wallpaper according to claim 2, wherein the embossing is performed with one of a heated embossing roller and a heated embossing plate.

4. A method for forming embossed wallpaper from a medium including a base member and a thermoplastic resin layer deposited on the base member, the thermoplastic resin layer being made from a material including a thermoplastic resin, the method comprising:

forming an ink receiving layer, which is adapted to absorb ink-jet ink, on the thermoplastic resin layer of the medium, heating and embossing the medium to form an uneven pattern on a surface of the medium after the forming of the ink receiving layer; and ink jet printing after the heating and embossing.

5. A method for forming embossed wallpaper according to claim 4, wherein the embossing is performed concurrently with the heating.

6. A method for forming embossed wallpaper according to claim 5, wherein the embossing is performed with one of a heated embossing roller and a heated embossing plate.

7. A method for forming embossed wallpaper from a medium including a base member and a thermoplastic resin layer deposited on the base member, the thermoplastic resin layer being made from a material including a thermoplastic resin and a foaming agent mixed into the thermoplastic resin, the method comprising:

forming an ink receiving layer, which is adapted to absorb ink-jet ink, on the thermoplastic resin layer of the medium;

foaming and then embossing the thermoplastic resin to form an uneven pattern on a surface of the medium after the formation of the ink receiving layer; and ink jet printing after the foaming and embossing.

8. A method for forming embossed wallpaper according to claim 7, wherein the foaming agent comprises a heat foaming agent, and the foaming is performed by heating.

9. A method for forming embossed wallpaper according to claim 8, wherein the foaming is performed by heating prior to the embossing.

10. A method for forming embossed wallpaper according to claim 7, wherein the embossing is performed with one of a heated embossing roller and a heated embossing plate.

11. A method for forming embossed wallpaper from a medium including a base member and a thermoplastic resin prefoam layer deposited on the base member, the method comprising:

forming an ink receiving layer, which is adapted to absorb ink-jet ink, on the thermoplastic resin prefoam layer of the medium, heating and embossing the medium to form an uneven pattern on a surface of the medium after the forming of the ink receiving layer; and ink jet printing after the heating and embossing.

12. A method for forming embossed wallpaper according to claim 11, wherein the embossing is performed concurrently with the heating.

13. A method for forming embossed wallpaper according to claim 12, wherein the embossing is performed with one of a heated embossing roller and a heated embossing plate.

* * * * *

UNITED STATES PATENT AND TRADEMARK OFFICE

CERTIFICATE OF CORRECTION

PATENT NO. : 6,688,741 B2
DATED : February 10, 2004
INVENTOR(S) : Masaji Nishikawa It is certified that error appears in the above-identified patent and that said Letters Patent is hereby corrected as shown below:

Title page,
Item [73], Assignee, change "University of Southern California, Los Angeles, CA (US)" to -- Olympus Optical Co., Ltd., Tokyo (JP) --

Signed and Sealed this

Twenty-ninth Day of June, 2004

JON W. DUDAS
*Acting Director of the United States Patent and Trademark Office*